US006696212B2

(12) United States Patent
Marsh et al.

(10) Patent No.: US 6,696,212 B2
(45) Date of Patent: Feb. 24, 2004

(54) SINGLE COMPONENT TONER FOR IMPROVED MAGNETIC IMAGE CHARACTER RECOGNITION

(75) Inventors: Dana G. Marsh, Newark, NY (US); John F. Crichton, Honeoye Falls, NY (US); David D. Putnam, Fairport, NY (US); Robert E. Contois, Rochester, NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/818,253

(22) Filed: Mar. 27, 2001

(65) Prior Publication Data

US 2002/0192583 A1 Dec. 19, 2002

(51) Int. Cl.[7] ..... G03G 13/08
(52) U.S. Cl. ..... 430/120; 430/108.6; 430/108.7
(58) Field of Search ..... 430/108.6, 108.7, 430/120, 39, 122

(56) References Cited

U.S. PATENT DOCUMENTS

| | | | | |
|---|---|---|---|---|
| 2,229,513 A | | 1/1941 | Lustig | |
| 2,297,691 A | | 10/1942 | Carlson | |
| 3,893,935 A | | 7/1975 | Jadwin et al. | |
| 3,998,160 A | | 12/1976 | Pearce | |
| 4,079,014 A | | 3/1978 | Burness et al. | |
| 4,160,644 A | | 7/1979 | Ryan | |
| 4,323,634 A | | 4/1982 | Jadwin | |
| RE31,072 E | | 11/1982 | Jadwin et al. | |
| 4,394,430 A | | 7/1983 | Jadwin et al. | |
| 4,414,152 A | | 11/1983 | Santilli et al. | |
| 4,416,965 A | | 11/1983 | Sandhu et al. | |
| 4,449,168 A | | 5/1984 | Ewing | |
| 4,517,268 A | * | 5/1985 | Gruber et al. | 430/39 |
| 4,624,907 A | | 11/1986 | Niimura et al. | |
| 4,683,188 A | | 7/1987 | Suzuki et al. | |
| 4,780,553 A | | 10/1988 | Suzuki et al. | |
| 4,814,250 A | | 3/1989 | Kwarta et al. | |
| 4,824,752 A | | 4/1989 | Yasuda et al. | 430/106.6 |
| 4,834,920 A | | 5/1989 | Bugner et al. | |
| 4,840,864 A | | 6/1989 | Bugner et al. | |
| 4,859,550 A | | 8/1989 | Gruber et al. | |
| 4,912,009 A | | 3/1990 | Amering et al. | |
| 4,973,540 A | * | 11/1990 | Machida et al. | 430/108.6 |
| 5,332,639 A | | 7/1994 | Nakamura et al. | 430/110 |
| 5,358,814 A | | 10/1994 | Osterhoudt et al. | 430/106.6 |
| 5,364,722 A | | 11/1994 | Tanikawa et al. | |
| 5,482,805 A | * | 1/1996 | Grande et al. | 430/108.21 |
| 5,637,432 A | * | 6/1997 | Okado et al. | 430/108.6 |
| 5,658,991 A | | 8/1997 | Kosaka et al. | |
| 5,747,213 A | | 5/1998 | Okado et al. | |
| 5,776,646 A | * | 7/1998 | Hagi et al. | 430/108.6 |
| 5,811,214 A | | 9/1998 | Osterhoudt et al. | |
| 5,849,848 A | | 12/1998 | Kosaka et al. | |
| 5,952,138 A | * | 9/1999 | Kuwashima et al. | 430/39 |
| 5,976,750 A | * | 11/1999 | Hagi et al. | 430/108.7 |
| 6,087,059 A | * | 7/2000 | Duggan et al. | 430/108.6 |
| 6,187,489 B1 | | 2/2001 | Oishi et al. | 430/45 |
| 6,287,739 B1 | * | 9/2001 | Kawakami et al. | 430/108.7 |
| 6,294,303 B1 | * | 9/2001 | Putnam et al. | 430/120 |
| 6,338,929 B1 | * | 1/2002 | Hagi et al. | 430/108.6 |

FOREIGN PATENT DOCUMENTS

| | | | |
|---|---|---|---|
| EP | 0 874 286 A1 | 10/1998 | G03G/9/097 |
| GB | 1420839 | 5/1973 | |
| GB | 1501065 | 7/1976 | |

* cited by examiner

*Primary Examiner*—Christopher Rodee

(57) ABSTRACT

Magnetic toner particles are disclosed. The magnetic toner particles contain at least one polymeric binder and at least one magnetic additive, wherein the surface of the toner particle contains particles of positively chargeable inorganic fine powder particles. The inorganic fine powder particles have a mean volume average particle size of from about 0.5 to about 7 $\mu$m, and a cleaning ratio of from about 0.1 to about 5.0 and a cleaning ratio being the volume fraction of particles between 0 and 1.0 $\mu$m, divided by the volume fraction of particles greater than 1.0 $\mu$m; and the toner particles having on the surface thereof a flowability improving agent having a BET surface area of at least about 30 $m^2/g$. Methods of forming electrostatic images are further disclosed. Also, images formed from the magnetic toner particles are further disclosed and have excellent character void frequency, total void area, and suitable magnetic signal strengths. Developers containing the magnetic toner particles of the present invention are also disclosed.

16 Claims, No Drawings

SINGLE COMPONENT TONER FOR IMPROVED MAGNETIC IMAGE CHARACTER RECOGNITION

BACKGROUND OF THE INVENTION

The present invention relates generally to improved magnetic single component toner compositions for use in generating documents suitable for magnetic image character recognition. In particular, the present invention relates to improved magnetic single component toner compositions preferably containing no charge agents nor heavy metals.

The formation and development of images on the surface of photoconductive materials by electrostatic means is well known. The basic electrophotographic process, as taught by C. F. Carlson in U.S. Pat. No. 2,297,691 (incorporated in its entirety by reference herein), involves forming a uniform electrostatic charge on the surface of a photoconductive layer, exposing the layer to an image to dissipate the charge in light exposed areas, and developing the resulting latent electrostatic charge image by depositing dry toner compositions on the image.

Magnetic ink printing methods with inks containing magnetic particles are also known. For example, U.S. Pat. No. 3,998,160 (incorporated herein in its entirety by reference) relates to various magnetic inks used in printing digits, characters, or designs on checks or bank notes. The magnetic ink used for these processes consists of acicular magnetic particles, such as magnetite in a fluid medium, and a magnetic coating of ferric oxide, chromium dioxide, or similar materials dispersed in a vehicle containing binders and plasticizers.

While magnetic ink or toner can be used only in the MICR characters in some applications, many other applications require the ink or toner to produce acceptable image quality over the rest of the document as well. For example, a refund check may be attached through perforations at the bottom or top of a financial statement to which it pertains. It is often desirable to print the entire statement and check at the same time to avoid possible mismatch between statement and check amount. As a result, image quality specifications such as solid area density, linewidth, and background need to be met at the same time that adequate magnetic properties are maintained.

Single component toner compositions generally contain, for example, magnetic particles, such as magnetite, resin binders, and other additives. There are several types of magnetites ranging from soft to hard. Generally, there are three types of iron oxides used: (1) cubic; (2) octahedral; and (3) acicular. U.S. Pat. No. 4,859,550 (incorporated in its entirety by reference herein) indicates that hard and/or soft magnetites may be incorporated into toner at amounts of from 35–70% by weight.

In applications requiring MICR capabilities, toners must generally contain magnetites having specific properties, the most important of which is a high enough level of remanence or retentivity. Retentivity is a measure of the magnetism left when the magnetite is removed from the magnetic field, i.e., the residual magnetism. In applications requiring MICR capability, it is important for the toner to show a high enough retentivity such that when the characters are read, the magnetites produce a signal. This is the signal strength of the toner composition. The magnetic signal level is of substantial importance in MICR systems. The signal level can vary in proportion to the amount of toner deposited on the document being generated. Signal strength of a toner composition can be measured by using known devices, including the MICR-Mate 1, manufactured by Checkmate Electronics, Inc.

Effective MICR toner compositions must have magnetic characteristics which meet banking industry requirements for character signal strength. Each MICR character has its own unique signal strength pattern due both to character shape and the toner content. In a typical signal strength tester, a MICR-Mate 1 reading device is calibrated against a standard printed "on-us" character known to represent 100% signal strength. Test samples are then read on the calibrated reading device to determine what their signal strength is in relation to the standard. Different banking organizations have different standards for what constitutes an acceptable signal strength in order to avoid excessive document rejects by high speed automated reader-sorters. For example, the U.S. (ANSI) standard is 70–200%, whereas the Canadian standard is 100–200%.

Toner compositions used in single component development applications, i.e., those having 40–50% soft magnetites, typically have a low retentivity and a low signal strength. Soft or cubic magnetites give a low retentivity whereas octahedral and acicular magnetites give a higher retentivity. Therefore, past toner compositions have contained high levels of acicular magnetites to provide the desired retentivity. However, the use of toner compositions with all acicular magnetites is expensive, and often exhibit signal strengths that are too high.

Single component toners generally use soft magnetites, wherein $\rho_R$ at saturation is less than 15 emu/g. Such magnetites, when present in the toner from 30–60%, will provide sufficient magnetic moment to satisfy the electrophotographic development requirements. However, the toner retentivity may be insufficient to satisfy MICR signal strength requirements due to the presence of soft magnetites. Although the problem can be overcome by increasing the loading of soft magnetite beyond 60%, the higher loadings of soft magnetite can result in low optical density and negatively impact other toner properties such as increased fines, increased minimum fusing temperature, and free magnetite on the surface of the toner. Conversely, if only hard magnetite is used, wherein $\rho_R$ is greater than 25 emu/g, the electrophotographic development required to obtain satisfactory line and solid area density without background results in a signal strength that is too high and unacceptable for MICR applications.

A further problem for single component development toner compositions containing high loadings of magnetites for MICR applications is that printed characters exhibit an unacceptable degree of abrasion or rub-off after multiple passes through a reader/sorter. Such wear may result in the document being rejected by the reader. The toner abrasion also results in contamination of the read/write heads, which can result in false readings. It has been found that the wearability of MICR characters can be substantially improved by incorporating a wax in the toner. U.S. Pat. No. 4,859,550 (incorporated in its entirety by reference herein) relates to the addition of certain polymeric waxes to minimize image smearing. A further reason for using waxes in a toner composition is as a fusing release agent.

Accordingly, there is a need to provide a single component toner composition which will obtain sufficiently high retentivity for MICR applications without the high levels of magnetite loadings that could negatively impact the toner rheological properties and contribute to higher toner cost. At the same time, the toner formulation should reduce sorter image abrasion (rub-off), reduce character void frequency and total void area image defects, and/or not contain heavy metal charge control agents.

SUMMARY OF THE PRESENT INVENTION

A feature of the present invention is to provide a single component magnetic toner for MICR applications having solved the above mentioned problems.

Another feature of the present invention is to provide a single component magnetic toner capable of high line and solid area density.

A further feature of the present invention is to provide a single component magnetic toner capable of providing clear images free of background and MICR characters free from a lowering in recognition rate.

An additional feature of the present invention is to provide a single component magnetic toner useful in MICR applications, wherein the composition is free from charge agents containing heavy metals.

Still another feature of the present invention is to provide a single component magnetic toner useful in MICR applications which enables MICR characters free from character void image defects.

An additional feature of the present invention is to provide a single component magnetic toner useful in MICR applications which are abrasion resistant, do not show rub-off, and do not cause a decrease in recognition rate even on repetitive passage through a MICR reader/sorter.

Additional features and advantages of the present invention will be set forth in part in the description which follows, and in part will be apparent from the description, or may be learned by practice of the present invention. The objectives and other advantages of the present invention will be realized and attained by means of the elements and combinations particularly pointed out in the written description and appended claims.

The present invention relates to an improved single component electrostatographic developer. The developer preferably includes negatively charging toner particles. The particles include at least one polymeric binder and at least one magnetic material or additive, wherein the toner particle surface contains particles of positively chargeable inorganic fine powder particles. The invention is further characterized in that:

the inorganic fine powder particles have a mean volume average particle size of from about 0.5 to 7 $\mu$m, and a cleaning ratio of from about 0.1 to about 5.0;

the cleaning ratio being the volume fraction of particles between 0 and 1.0 $\mu$m, divided by the volume fraction of particles greater than 1.0 $\mu$m; and the particles having on the surface thereof a flowability improving agent preferably having a BET surface area of at least 30 $m^2/g$.

This developer preferably provides outstanding line and solid area image density, reduced rub-off and hollow character image quality defects, and/or excellent suppression of degradation of recognition rate in MICR applications.

The toner preferably comprises, based on the weight of the toner, from about 40 to about 60 wt. % polymer; from about 30 to about 55 wt. % magnetic material; optionally from about 1 to about 5 wt. % release agent; from about 0.2 to about 2.0 wt. % hexamethyldisilizane treated hydrophobic silicon dioxide; and from about 1.0 to about 6.0 weight % cerium oxide rich inorganic fine powder.

The present invention further relates to a method of forming an electrostatic magnetic image involving forming an electrostatic latent image on a surface of an electrophotographic element and developing the image by contacting the latent image with the monocomponent electrostatographic developer described above.

The present invention further relates to magnetic toner particles having at least one magnetic additive and at least one resin, and optionally at least one non-heavy metal containing charge agent, and optionally at least one colorant, wherein the magnetic toner particles have a toner particle surface having particles of positively chargeable inorganic fine powder particles. The image developed with the magnetic toner particles have at least one of the following characteristics: a) a character void frequency of about 1.5 or less: b) a character void area of about 1 or less; c) a magnetic signal strength of from about 75% to about 115%, or d) a 3 PSI rub-off of from about 3.5 to about 15.

The present invention further relates to developers containing the magnetic toner particles described above.

It is to be understood that both the foregoing general description and the following detailed description are exemplary and explanatory only and are intended to provide a further explanation of the present invention, as claimed.

DETAILED DESCRIPTION OF THE PRESENT INVENTION

The present invention relates to toner particles and developers containing the toner particles. In particular, the present invention relates to a magnetic monocomponent developer containing negatively charging particles. The toner particles contain at least one polymeric binder and at least one magnetic material or additive. The toner particles have a toner particle surface containing particles of a positively chargeable inorganic fine powder particles. The positively chargeable inorganic fine powder particles preferably have the following characteristics: a mean volume average particle size of from about 0.5 to about 7 $\mu$m, and a cleaning ratio of from about 0.1 to about 5.0; wherein the cleaning ratio is the volume fraction of particles between 0 and 1.0 $\mu$m, divided by the volume fraction of particles greater than 1.0 $\mu$m. The positively chargeable inorganic fine powder particles preferably have on the surface thereof a flowability improving agent preferably having a BET surface area of at least about 30 $m^2/g$.

The present invention further relates to magnetic toner particles and developers containing magnetic toner particles having a variety of beneficial characteristics such as excellent character void frequency; character void area; excellent magnetic signal strength; and/or low rub-off.

The present invention is also directed to electrostatic processes for generating documents suitable for magnetic image character recognition involving the use of the magnetic toner compositions of the present invention. In an embodiment of the present invention, personal checks can be prepared and printed in a very simple and economical manner by conventional electrophotography with the magnetic dry toner compositions of the present invention.

In the field of magnetic image character recognition, magnetic single component toner compositions are preferred due to their lack of need for separate carrier particles. However, magnetic single component toner compositions still need to satisfy the various demands of the industry for MICR applications including a sufficient magnetic signal strength, an acceptable total void area, and a low character void frequency. In addition, high image quality would be preferred as long as the magnetic signal strength is not jeopardized. In the past, the industry has simply accepted the lower quality of image in view of the need for the adequate magnetic signal strength that must be present in the MICR toner.

The present invention relates to improved magnetic single component toner compositions for use in generating documents suitable for magnetic image character recognition. The toner compositions of the present invention can be used in standard developers such as, but not limited to, single-component electrophotographic developing devices employing a charged area and discharged area development using conductive or insulative developer compositions.

In the present invention, the magnetic single component toner compositions have the ability to enable the use of significantly lower magnetic signal strength with respect to the image because the character void frequency and the total void area of the same image is very low. Thus, there is no need to compensate for poor image quality due to the use of large magnetic loadings and the resulting large magnetic signal strength. In addition, with low character void frequency and low void area of the printed image, the magnetic single component toner compositions of the present invention can be used for normal printing applications as well as MICR applications. In other words, the magnetic single component toner compositions of the present invention can be used for dual printing applications. Thus, there is no need to have separate image development using two different toners since toners of the present invention permit acceptable image quality as well as acceptable magnetic signal strengths for the MICR requirements.

In the present invention, an image printed or developed using the toner compositions of the present invention can have character void frequencies of about 1.5 or less, and preferably about 0.5 or less, and more preferably about 0. The same image can have a character void area of about 1.0 or less, more preferably about 0.5 or less, even more preferably about 0.01 or less, and most preferably about 0. Furthermore, the magnetic signal strength of the same images can be low, as stated above, and is preferably from about 75% to about 115%, and more preferably from about 90% to about 105%, and even more preferably from about 90% to about 100% as measured by the MICR-MATE, manufactured by Check Mate Electronics, Inc. Also, the same image preferably has a 3 PSI rub-off of from about 3.5 to 15, and more preferably a 3 PSI rub-off of from about 3.5 to about 10, and even more preferably a 3 PSI rub-off of from about 3.5 to about 5.

The toners of the monocomponent developer composition of the invention contain at least one polymeric binder and at least one magnetic material. Optionally, the toner may include a surface treatment charge control agent or flowability improving agent, a release agent such as a wax, colorants, and other additives.

The magnetic toner particles of the present invention contain at least one type of magnetic additive or material, such as soft iron oxide ($Fe_3O_4$) which is dispersed in the toner or ink and thus makes the toner or ink ferro-magnetic. The magnetic materials included in the monocomponent toner of the present invention are generally of the soft type magnetic materials conventionally used in toners. Examples of useful magnetic materials include mixed oxides of iron, iron silicon alloys, iron aluminum, iron aluminum silicon, nickel iron molybdenum, chromium iron, iron nickel copper, iron cobalt, oxides of iron and magnetite. Other suitable magnetic materials that can be present in the toner include, but are not limited to, magnetic material containing acicular magnetites, cubical magnetites, and polyhedral magnetites. A useful soft iron oxide is TMB1120 from Magnox Inc.

The amount of the magnetic material in the magnetic toner particles of the present invention can be any amount sufficient to preferably meet commercial needs, such as providing a sufficient signal strength for the toners developed as an image. Preferably, the amount of magnetic loading in the toner compositions of the present invention is from about 40% to about 50% by weight of the toner particles, and more preferably from about 42% to about 45% by weight of the toner particles.

Furthermore, the present invention preferably contains no core charge agents and no heavy metals, though the presence of such ingredients are optional. However, the ingredients are not necessary.

As noted above, it is conventional to include a cleaning aid in a monocomponent developer composition. Certain specific characteristics of the cleaning aid and other features provide for improved results.

In preparing the monocomponent composition of the present invention, the toner is preferably first treated with a flowability improving agent, such as silicon dioxide. Thereafter, the toner is treated with a positively chargeable inorganic fine powder (IFP). In the first step, the toner surface is preferably treated with from about 0.2 to about 2.0 weight % silicon dioxide, and more preferably from about 0.48 to about 1.0 weight percent silicon dioxide, and even more preferably from about 0.70 to about 1.0 weight % silicon dioxide based on the weight of the toner, wherein the silicon dioxide preferably has a BET surface area of at least about 30 $m^2/g$. In the second step, the toner is treated with from about 1.0 to about 6.0 weight % IFP based on the total weight of the mixture of the toner and silicon dioxide.

The flowability improving agent can be treated silicon dioxide. Other materials can also be used. A useful treated silicon dioxide is hexamethyldisalizane treated silicon dioxide that is commercially available from Degussa as Aerosil™ R812. The IFP added to the developer can be pure cerium dioxide, pure strontium titanate, or cerium oxide-rich or strontium titanate rich polishing aids. Useful positively chargeable inorganic fine powders have a mean volume average particle size of from about 0.5 to about 7 $\mu$m. Cerium dioxide rich polishing aids are commercially available from Ferro Electronic Materials. Strontium Titanate (99% pure) is available from Sigma-Aldrich. Milling or classification of the IFP or combinations of milled and classified IFPs can also be accomplished to produce the desired particles size distribution. SRS 135 from Ferro Electronic materials is a milled version of their SRS 123. SRS 123C was classified by CCE technologies from SRS 123. A useful composition is a mixture of STS 123C and SRS 135 in the ratio 30:70 to 70:30 by weight.

The inorganic fine powder (IFP) added to the developer can be a pure material or mixtures of materials. Cerium dioxide or mixtures of cerium dioxide may be used advantageously as cleaning aids to ensure that the photoconductive element is not contaminated and to ensure that the surface of the developer roll sleeve is not scummed or otherwise contaminated. The positively chargeable inorganic fine powder is attracted to the vicinity of the surface of the developer roll sleeve during the development process. The cerium dioxide effectively cleans the surface of the developer roll sleeve and removes any toner or other contaminants.

Contamination of the surface of the developer roll sleeve can degrade image quality. Toner or other materials that become physically attached to the surface of the developer roll sleeve can result in decreasing the charge-to-mass of the toner by interfering with the triboelectric interaction between the surface of the toner particle and the surface of the developer roll sleeve. The poorly charged toner particles may not develop onto the image areas of the photoconductor and image reflection density may be lowered and background increased. In addition, the presence of attached (scummed) toner on the surface of the developer roll sleeve can cause localized irregularities in the surface of the toner on the developer roll sleeve. These surface irregularities may in some cases result in reproduction of non-uniform solid area density particularly for low-density originals.

To avoid image quality degradation due to contamination of the developer roll sleeve, appropriate positively chargeable inorganic fine powder (IFP) cleaning aids are preferably used. The appropriate weight percent of cleaning aid based on toner weight is preferably used. Preferably, the weight percent cleaning aid is from about 1.0 wt. % to about 6.0 wt. %. If the cleaning aid is added in an amount below about 1.0 wt. %, insufficient IFP cleaning aid may be available in the region of the surface of the developer roll sleeve surface and scumming and contamination may occur. This might result in degradation of image quality. On the other hand, if cleaning aid is added in an amount above about 6.0 wt. %, the cleaning aid may not be adequately attached to the surface of the toner, and machine contamination may occur. In addition, triboelectric charging between the surface of the toner and the surface of the developer roll sleeve may be prevented resulting in low charge-to-mass of the toner and low image density. The preferred amount is from about 2.0 to 4.0 wt. % of positively charging inorganic fine powder particles.

According to the present invention, the particle size distribution (PSD) of the cleaning aid is preferably controlled. The mean volume average diameter of the cleaning aid is preferably maintained between an upper and lower limit. If the mean volume average particle size of the particles in the powder of the cleaning aid is below about 0.5 $\mu$m, image density may be degraded. On the other hand, if the mean volume average particle size of the cleaning aid is above about 7.0 $\mu$m, the cleaning aid is not efficient in preventing contamination of the surface of the developer roll sleeve.

Also, according to the present invention, the range of the volume mean particle size of the cleaning aid and the ratio of particles size of the cleaning aid and the ratio of particle sizes below and above 1.0 $\mu$m mean volume average diameter are preferably controlled. The "cleaning ratio" is preferably controlled in the range of from about 0.1 to about 5.0. More preferably, the cleaning ratio is from about 0.76 to about 4.0 and even more preferably is from about 0.3 to about 4.0. Other preferred cleaning ratio ranges include from about 0.6 to about 4.0, and from about 0.8 to about 4.0. The cleaning ratio is defined as the volume fraction of particles of from 0 to 1.0 $\mu$m, divided by the volume fraction of particles greater than 1.0 $\mu$m. Stated as a formula:

$$\text{Cleaning Ratio}=\text{volume fraction 0 to 1.0 } \mu m/\textit{volume fraction}>1.0\ \mu m$$

A cleaning aid with cleaning ratio below 0.1 has a high proportion of large particles. This situation results in good image density and background image quality. A cleaning aid ratio greater than about 4.0 has a high proportion of small particles. This condition results in decreasing toner laydown onto the surface of the developer roll sleeve, reduced charge-to-mass of the toner, non-uniform solid area image density, lowered image density, and/or higher background.

In a typical manufacturing process, the desired polymeric binder for toner application is produced. Polymeric binders for electrostatographic toners are commonly made by polymerization of selected monomers followed by mixing with various additives and then grinding to a desired size range. During toner manufacturing, the polymeric binder is subjected to melt processing in which the polymer is exposed to moderate to high shearing forces and temperatures in excess of the glass transition temperature of the polymer. The temperature of the polymer melt results, in part, from the frictional forces of the melt processing. The melt processing includes melt-blending of toner addenda, including the magnetic material, into the bulk of the polymer.

The polymer may be made using a limited coalescence reaction such as the suspension polymerization procedure disclosed in U.S. Pat. No. 4,912,009 to Amering et al., which is incorporated in its entirety by reference herein.

Useful binder polymers include vinyl polymers, such as homopolymers and copolymers of styrene. Styrene polymers include those containing 40 to 100 percent by weight of styrene, or styrene homologs, and from 0 to 40 percent by weight of one or more lower alkyl acrylates or methacrylates. Other examples include fusible styrene-acrylic copolymers that are covalently lightly crosslinked with a divinyl compound such as divinylbenzene. Binders of this type are described, for example, in U.S. Reissue Pat. No. 31,072, which is incorporated in its entirety by reference wherein. Preferred binders comprise styrene and an alkyl acrylate and/or methacrylate and the styrene content of the binder is preferably at least about 60% by weight.

Copolymers rich in styrene such as styrene butylacrylate and styrene butadiene are also useful as binders as are blends of polymers. In such blends, the ratio of styrene butylacrylate to styrene butadiene can be 10:1 to 1:10. Ratios of 5:1 to 1:5 and 7:3 are particularly useful. Polymers of styrene butylacrylate and/or butylmethacrylate (30 to 80% styrene) and styrene butadiene (30 to 80% styrene) are also useful binders.

Styrene polymers include styrene, alpha-methylstyrene, para-chlorostyrene, and vinyl toluene; and alkyl acrylates or methylacrylates or monocarboxylic acids having a double bond selected from acrylic acid, methyl acrylate, 2-ethylhexyl acrylate, 2-ethylhexyl methacrylate, ethyl acrylate, butyl acrylate, dodecyl acrylate, octyl acrylate, phenylacrylate, methylacrylic acid, ethyl methacrylate, butyl methacrylate and octyl methacrylate and are also useful binders. Also useful are condensation polymers such as polyesters and copolyesters of aromatic dicarboxylic acids with one or more aliphatic diols, such as polyesters of isophthalic or terephthalic acid with diols such as ethylene glycol, cyclohexane dimethanol, and bisphenols.

A useful binder can also be formed from a copolymer of a vinyl aromatic monomer; a second monomer selected from either conjugated diene monomers or acylate monomers such as alkyl acrylate and alkyl methacrylate.

Release agents can be used in the monocomponent toner compositions. Useful release agents are well known in this art. Useful release agents include low molecular weight polypropylene, natural waxes, low molecular weight synthetic polymer waxes, commonly accepted release agents, such as stearic acid and salts thereof, and others. More specific examples are copolymers of ethylene and propylene preferably having a molecular weight of from about 1000 to about 5000 g/mole, particularly a copolymer of ethylene and propylene having a molecular weight of about 1200 g/mole. Additional examples include synthetic low molecular weight polypropylene waxes preferably having a molecular weight from about 3,000 to about 15,000 g/mole, such as a polypropylene wax having a molecular weight of about 4000 g/mole. Other suitable waxes are synthetic polyethylene waxes. Preferably, the release agent contains at least one wax, wherein the wax is preferably present in an amount of from about 1 wt % to about 3 wt %, based on the weight of the toner. Suitable waxes can be obtained from a variety of companies, including Baker-Hughes/Baker Petrolite, Sanyo Chemical Industries, Mitsui Petrochemical, and Clariant Corporation.

An optional additive for the toner is the charge control agent. The term "charge-control" refers to a propensity of a toner addendum to modify the triboelectric charging properties of the resulting toner. A very wide variety of charge control agents for positive and negative charging toners are available. Suitable charge control agents are disclosed, for example, in U.S. Pat. Nos. 3,893,935; 4,079,014; 4,323,634; 4,394,430; and British Patent Nos. 1,501,065 and 1,420,839, all of which are incorporated in their entireties by reference herein. Additional charge control agents which are useful are described in U.S. Pat. Nos. 4,624,907; 4,814,250; 4,840,864; 4,834,920; 4,683,188; and 4,780,553, all of which are incorporated in their entireties by reference herein. Mixtures of charge control agents can also be used. Particular examples of charge control agents include chromium salicylate organo-complex salts, and azo-iron complex-salts, an azo-iron complex-salt, particularly ferrate (1-), bis[4-[(5-chloro-2-hydroxyphenyl)azo]-3-hydroxy-N-phenyl-2-naphthalenecarboxamidato(2-)], ammonium, sodium, and hydrogen (Organoiron available from Hodogaya Chemical Company Ltd.).

Another optional additive for the toner is a colorant. In some cases the magnetic component acts as a colorant negating the need for a separate colorant. Suitable dyes and pigments are disclosed, for example, in U.S. Reissue Pat. No. 31,072 and in U.S. Pat. Nos. 4,160,644; 4,416,965; 4,414,152; and 2,229,513, all incorporated in their entireties by reference herein. One particularly useful colorant for toners to be used in black and white electrostatographic copying machines and printers is carbon black. Colorants are generally employed in the range of from about 1 to about 30 weight percent on a total toner powder weight basis, and preferably in the range of about 2 to about 15 weight percent.

The developer of the present invention is preferably made in several steps. In the first step, the polymer, magnetic material, and release agent are preferably melt blended in a two roll mill or an extruder. The blend is ground, and classified to achieve a particular toner size distribution. The toner preferably has a number average median diameter of from about 3 to about 15 $\mu$m, or preferably has a volume average median diameter of from about 5 to about 20 $\mu$m. The desired toner preferably has a number average median diameter of from about 6.5 to about 8.5 $\mu$m and preferably a volume average median diameter of from about 8.5 to about 10.5 $\mu$m. A mixture of silicon dioxide particles and positively chargeable inorganic fine powder are added to the toner and preferably mixed according to the procedural steps described above and exemplified in the following examples. Mixing can be carried out in a high-speed mixer, such as a Henschel mixer. As stated above, the silicon dioxides are preferably added in a first mixing step and particles of positively chargeable inorganic fine powder in a second mixing step.

The toner preferably comprises, based on the weight of the toner, from about 40 to about 60 wt % polymer; from about 30 to about 55 wt % magnetic additive or material; optionally from about 1 to about 5 wt % release agent; and the preferred concentrations of silicon dioxide and positively chargeable inorganic fine powder described above, all based on the weight of the toner.

The toner can also contain other additives of the type used in previous toners, including magnetic pigments, colorants, leveling agents, surfactants, stabilizers, and the like.

The present invention further relates to methods of forming images using the toners and developers of the present invention. Generally, the method includes forming an electrostatic latent image on a surface of an electrophotographic element and developing the image by contacting the latent image with the monocomponent electrostatic developer of the present invention. As stated earlier, the toner compositions of the present invention have the ability to provide excellent image quality without any sacrifice to the magnetic signal strength necessary to achieve the desired banking industry requirements.

The term "particle size" used herein, or the term "size," or "sized" as employed herein in reference to the term "toner particles," means the median volume average diameter as measured by conventional measuring devices, such as a Coulter Multisizer, sold by Coulter, Inc. of Hialeah, Fla. The term positively chargeable inorganic fine powder particle size refers to the mean volume average diameter as measured by a laser scattering particle size distribution analyzer, such as the Horiba LA910, sold by Horiba Instruments.

As mentioned above, images formed from the toner particles of the present invention further have high line and solid area density. This leads to images formed from the toner particles of the present invention having satisfactory performance for MICR applications as well as normal printing operations. As can be seen, for instance, in the examples, the line width, solid area density, and solid area transmission were sufficient and comparable to images formed from non-magnetic toner compositions. Furthermore, the images formed from the toner compositions of the present invention are abrasion resistant, have rub-off resistance, and do not cause a decrease in recognition rate even on repetitive passages through a microreader/sorter.

Analytical Methods

Particle Size Distribution

The particle size distribution of the positively chargeable inorganic fine powder (IFP) is measured by means of a Horiba LA910 laser scattering particle size distribution analyzer (available from Horiba Instruments). For measurement, 0.02 g of sample is first dispersed with 2 mL of a 0.25% Tamol SN aqueous solution (or other alkylbenzenesulfonic acid). 100 mL of water is then added to the sample and is subjected to measurement. The analyzer is run with the ultrasonics on at a power level output setting of 3 and circulation setting of 3. The particle size distributions used in the examples, were all measured by Ferro Electronic Materials according to the method described above. From the particle size distribution, the mean volume average particle size can be calculated. An effective cleaning ratio is calculated from the volume distribution. The cleaning ratio is the volume fraction of particles between 0 and 1.0 $\mu$m, divided by the volume fraction of particles greater than 1.0 $\mu$m.

Rub-Off Procedure

The test apparatus for measuring rub-off from an image-bearing substrate having a first side and a second side with a toner image on the first side has a flat surface having a first and second end and adapted to support a first substrate with one of its ends extending beyond the first end of the flat surface (test sheet); a restrainer for preventing movement of the second substrate (receiver sheet) along the length of the flat surface; a pressure pad adapted to impose a selected pressure on the first substrate and the second substrate in a test area; a puller adapted to pull the first substrate a selected distance through the test area relative to the second substrate; a calibrated scanner; and, a computer program for converting the scanned results into a numerical test results. The test sheet is positioned with its first side against the receiver substrate. Any apparatus which is effective to move the image-bearing side of the test sheet an effective distance through a test area relative to the receiver sheet and in contact with the receiver sheet at a selected pressure is suitable.

The substrates tested are typically paper sheets. The test sheet is a paper sheet bearing on its first side a toner image. This sheet is positioned so that one of its ends extends beyond the first end of the flat surface for engagement and removal therefrom. The second sheet is then placed over the first sheet and fastened to restrain its movement relative to the flat surface. A pressure is then imposed on a test area typically near the first end of the flat surface. The first sheet is then pulled from the flat surface and the resulting toner rub-off in the test area is indicative of the rub-off from the test sheet.

Such an apparatus and test procedure are disclosed in U.S. Patent Application No. (unassigned), entitled "Rub-off Test Method and Apparatus," filed Mar. 13, 2001 by John R. Lawson, Gerard Darby II, and Joseph A. Basile, with Attorney Docket No. HEID-25,491, and this application is incorporated in its entirety by reference herein.

The test apparatus is designed to move the test sheet through a test area subject to a test pressure for a selected distance relative to the receiver sheet to determine the rub-off tendencies of the test sheet. It will be understood that the apparatus could operate with the test sheet above the receiver sheet so long as the test sheet is moved relative to the receiver sheet.

The measurement of rub-off is accomplished in two steps. The first step is to abrade the test sheet images on a suitable apparatus. The second step is to take the results of the abrasion test and analyze the results to obtain a quantitative measure of the rub-off characteristics of the test sheet.

The first step of generating the test sheets is accomplished by producing the test sheets on the system to be evaluated. The test prints for rub-off are desirably made up with text printed over the entire imaging area of an 8.5×11 inches sheet. A representative test sheet (target) is prepared. Desirably, the text is written on the test sheet at a suitable angle (i.e., seven degrees) relative to the horizontal. This is to eliminate streaks in the final image where breaks between words exist. In typical use, this target is rendered as a postscript file and sent to the printer. The printer then uses this input file to generate test sheets for evaluation under specific test conditions. Typically a standard paper, such as Hammermill Bond, is used for test-to-test consistency.

Once the test sheets have been made on the printer under study, the evaluation samples are made. These are generated by rubbing the test sheets (Hammermill Bond or any other standard paper) against the receiver sheets in a controlled manner. This control is obtained through the use of the apparatus described above To use the apparatus, the following steps are followed:

1. The test sheet is placed on the flat surface, face up. The sheet is aligned to a registration mark so that the leading edge of the test sheet protrudes beyond the first end of the flat surface.
2. The receiver sheet (second sheet) is placed on the test sheet. The receiver sheet is aligned with the first end of the flat surface. The other end of the receiver sheet is clamped in place.
3. A known weight is then placed in a holder and rests on the paper stack. The weight provides a known pressure on the stack in a test area. In these experiments, 3PSI was used.
4. The flat surface is then moved laterally until the leading edge of the test sheet engages a roller nip. The rollers turn and "grab" the test sheet and pull it out from under the receiver sheet at 21 inches per second. The relative motion between the test sheet and the receiver sheet causes the toner from the test print to be abraded by the receiver sheet in the test area. This results in a "toner smear" image on the receiver sheet. The level of "smearing" in the test area has been shown to correlate with the subjective measure of rub-off.
5. Steps 1 to 4 are repeated six times. The replicates may be handled in one of two ways. In the first method all six replicates are done with a selected pressure from about 0.5 to about 5 pounds per square inch (psi). In the second method, two samples are made at each of three pressures, such as 1, 2, and 3 psi. The differences in the analysis of the two methods are given in the next section.

To analyze the test sheets, the following procedure is followed:

1. Each test area is scanned on a calibrated scanner. The scanner is calibrated as follows:
   a) a step tablet of known density is scanned using the same scan conditions as used when the print is scanned;
   b) the contrast and zero point of the scanner are adjusted so that the digital values for the step tablets are at a predetermined value, within limits; and,
   c) the values of the step tablet are periodically checked when doing many scans (e.g., once an hour).
2. With the calibrated scanner, the six images from each test area are scanned. The scan options are selected to give the six scanned test areas sequential names. The scans are 230×230 pixels at 600 dots per inch in grayscale mode. The scanned test area is stored on the file server.
3. The data in the scanned files represent the luminance of the pixels in the scanned area. 0=black and 255=white. For each test area, the standard deviation of the luminance values is calculated. Standard deviation has been shown to provide a measure with a good signal-to-noise ratio that correlates with subjective evaluations of rub-off.
4. If all six test areas were made using the same weight, the standard deviation values for luminance are averaged and the average value is reported as the rub-off for the sample under test.
5. If the six test areas are made using three weights, the six standard deviation values are regressed against the pressures at which they were tested. A least squares regression curve, preferably a second order linear regression, is fit through this data and the estimated values for rub-off at predetermined pressures are calculated. These rub-off values as a function of pressure are the results reported for the test.
6. Confidence limits on the reported values are calculated for both data analysis methods and are typically +/−10% of the rub-off value.

A wide variety of apparatus can be used to maintain a pressure pad bearing a weight to produce the desired pressure in the test area in position. Basically, the pressure pad must be maintained in position so that it can exert the desired pressure on the top of the second sheet while being retained in position relative to the flat surface when either of the sheets is moved. This is can be accomplished by a variety of mechanical configurations. Such variations are obvious to those skilled in the art.

The following examples are presented for a better understanding of the positively chargeable inorganic fine powders used in the present invention and the core toner formulations used to evaluate them. IFPs used in the examples are listed in Table 1.

TABLE 1

| IFP | Product Name | Manufacturer |
|---|---|---|
| Cerium Dioxide rich | SRS135 | Ferro Electronic Materials |
| Cerium Dioxide rich | SRS350 | Ferro Electronic Materials |
| Cerium Dioxide rich | SRS123C | Classified version of SRS123 from Ferro Electronic Materials |

* classification done by CCE technologies

Core toners were prepared according to the following formulation recipes:

| Monocomponent Toner Core Production | % by weight (Core Toner) | | |
|---|---|---|---|
| Examples | 2–4, 6 | 1, 5 | 7 |
| Styrene butylacrylate/butylmethacrylate copolymer | 38.8 | 38.8 | 38.0 |
| Styrene butadiene copolymer | 16.5 | 16.5 | 16.3 |
| Magnox TMB1120 magnetic additive | 43.7 | 43.7 | 43.7 |
| Ethylene-propylene copolymer wax, 1200 g/mole | | 1 | 2 |
| Polypropylene wax, 4000 g/mole | 1 | | |

The above materials were melt blended on a twin screw extruder at about 200° C. average melt temperature to yield a uniform dispersion. The blended material was then jet milled and classified to give a toner product volume median average diameter of from about 9.0 to 9.5 $\mu$m.

Monocomponent Toner Developer Production

The toner prepared as described above was blended in a two step operation with a silicon dioxide in the first step and a positively chargeable inorganic fine powder in the second step. The mixture was effected using a Henschel high intensity mixer. In step 1 of the surface treatment, from 0.47% to 0.71% by weight of the silicon dioxide was dry blended with a core toner under high shear conditions. In the second step also under high shear conditions, 2.5 parts by weight of the IFP was dry blended with 100 parts of toner and $SiO_2$ from step 1 above to yield the final developer.

EXAMPLES

Example 1 (3MTR)

1.75 parts of cerium oxide rich Ferro SRS135 and 0.75 parts of cerium oxide rich Ferro SRS123C were blended with 100 parts of toner from step 1 of the surface treatment using a Henschel high intensity mixer. The core toner formulation used in step one was:

| | |
|---|---|
| Styrene butylacrylate/butylmethacrylate copolymer | 38.8% by weight |
| Styrene butadiene copolymer | 16.5% by weight |

-continued

| | |
|---|---|
| Magnox TMB1120 magnetic additive | 43.7% by weight |
| Ethylene-propylene copolymer wax, 1200 g/mole | 1.0% by weight |

and the level of surface treatment added was 0.65% Degussa R812 hexamethyldisilazane treated $SiO_2$ The developer was subjected to a 25 kilocopy print full system printing test on a Kodak IS50 mid-volume copier. The printed image checks were evaluated for line width, solid area density, solid area transmission, % magnetic signal strength, character void frequency, and total void area. The developer roll sleeve was also observed during the test for any scumming defects. If a scumming defect was present on the developer roll sleeve, the printed copies were evaluated to see if the defect imaged in the copy. Excellent image quality was obtained, and no developer roll sleeve scumming defects were observed using the composition of this example.

The MICR performance of the printed checks was as follows:

| | |
|---|---|
| Linewidth | 350–380 |
| Solid Area Reflection Density | 1.53 |
| Solid Area Transmission Density | 1.20 |
| % Magnetic Signal Strength | 100 ± 11.8 |
| Character Void Frequency | 0 |
| Total Void Area | 0 |
| 3 PSI Rub-Off | 3.6 |
| Cleaning Ratio | 0.76 |
| IFP Mean Volume Average Diameter (microns) | 2.12 |

Example 2

Example 1 was repeated except 1 wt % polypropylene wax 4000 g/mole, 0.47 wt % of Degussa R812 were used. Also 1.25 parts of SRS 123C and 1.25 parts cerium oxide rich SRS 135 were used.

The MICR performance for the printed checks was as follows:

| | |
|---|---|
| Solid Area Reflection Density | 1.49 |
| Solid Area Transmission Density | 1.04 |
| % Magnetic Signal Strength | 89 |
| Character Void Frequency | 0.5 |
| Total Void Area | 0.007 |
| Cleaning Ratio | 0.41 |
| IFP Mean Volume Average Diameter (microns) | 3.02 |

Example 3

Example 1 was repeated except 1 wt % polypropylene wax 4000 g/mole, 0.665 wt % of Degussa R812 were used. Also 1.25 parts of SRS 123C and 1.25 parts cerium oxide rich SRS 135 were used.

The MICR performance of the printed checks was as follows:

| | |
|---|---|
| Solid Area Reflection Density | 1.49 |
| Solid Area Transmission Density | 1.19 |

-continued

| | |
|---|---|
| % Magnetic Signal Strength | 93 |
| Character Void Frequency | 1.2 |
| Total Void Area | 0.003 |
| Cleaning Ratio | 0.42 |
| IFP Mean Volume Average Diameter (microns) | 3.20 |

Example 4

Example 1 was repeated except 1 wt % polypropylene wax 4000 g/mole, 0.483 wt % of Degussa R812 were used. Also 1.25 parts of SRS 123C and 1.25 parts cerium oxide rich SRS 135 were used.

The MICR performance of the printed checks was as follows:

| | |
|---|---|
| Solid Area Reflection Density | 1.48 |
| Solid Area Transmission Density | 1.10 |
| % Magnetic Signal Strength | 84 |
| Character Void Frequency | 0.67 |
| Total Void Area | 0.003 |
| Cleaning Ratio | 0.42 |
| IFP Mean Volume Average Diameter (microns) | 3.20 |

Example 5

Example 1 was repeated except 0.71 wt % of Degussa R812 were used. Also 0.75 parts of SRS 123C and 1.75 parts of cerium oxide rich SRS 135 were used. The MICR performance of the printed checks was as follows:

| | |
|---|---|
| Solid Area Reflection Density | 1.58 |
| Solid Area Transmission Density | 1.30 |
| % Magnetic Signal Strength | 100 |
| Character Void Frequency | 0.0 |
| Total Void Area | 0.0 |
| Cleaning Ratio | 0.82 |
| IFP Mean Volume Average Diameter (microns) | 2.09 |

Example 6

Example 1 was repeated except 1 wt % polypropylene wax 4000 g/mole, 0.71 wt % of Degussa R812 were used. Also 1.50 parts of SRS 123C, and 1.00 parts cerium oxide rich SRS 135 were used.

The MICR performance of the printed checks was as follows:

| | |
|---|---|
| Solid Area Reflection Density | 1.47 |
| Solid Area Transmission Density | 1.02 |
| % Magnetic Signal Strength | 93 |
| Character Void Frequency | 0.33 |
| Total Void Area | 0.005 |
| Cleaning Ratio | 0.33 |
| IFP Mean Volume Average Diameter (microns) | 3.51 |

Example 7

Example 1 was repeated except 2.0 wt % ethylene-propylene copolymer wax 1200 g/mole, 0.77 wt % of Degussa R812. Also 0.75 parts of SRS 123C, 0.875 parts cerium oxide rich SRS 135, and 0.875 parts of SRS 350 were used.

The MICR performance of the printed checks was as follows:

| | |
|---|---|
| Solid Area Reflection Density | 1.54 |
| Solid Area Transmission Density | 0.98 |
| % Magnetic Signal Strength | 107 |
| Character Void Frequency | 0.7 |
| Total Void Area | 0.001 |
| Cleaning Ratio | 0.87 |
| IFP Mean Volume Average Diameter (microns) | 2.25 |

The magnetic monocomponent toners satisfied the aims/specifications for MICR applications. Solid area reflection density was higher than for the two component MICR toner, while the transmission density was lower. The toner has no character voids or void areas. Signal strength was near the low end of the specification; however, lower signal strength was acceptable for images which exhibit no character voids.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

What is claimed is:

1. A method of MICR electrostatic magnetic imaging comprising the steps of:

forming an electrostatic latent image on a surface of an electrophotographic element; and developing the latent image by contacting the latent image with a monocomponent electrostatographic developer to produce a fused MICR image readable in a MICR reader/sorter, wherein said developer comprises negatively charging toner particles, wherein said toner particles comprise at least one polymer binder and at least one magnetic material, wherein said toner particles have a toner particle surface containing particles of positively chargeable inorganic fine powder particles, wherein:

said inorganic fine powder particles having a mean volume average particle size of from about 0.5 to 7 $\mu$m, and a cleaning ratio of from about 0.3 to about 4.0;

said cleaning ratio being the volume fraction of particles between 0 and 1.0 $\mu$m, divided by the volume fraction of particles greater than 1.0 $\mu$m; and the toner particles treated with a flowability improving agent having a BET surface area of at least about 30 $m^2/g$.

2. The method of claim 1, wherein the toner surface contains based on the weight of toner, (a) from about 0.2 to about 1.0 total weight percent of said flowability improving agent and (b) from about 1.0 to about 6.0 weight percent of said positively chargeable inorganic fine powder particles.

3. The method of claim 2, wherein the toner surface contains from about 2.0 to about 4.0 weight percent of said positively charging inorganic fine powder particles.

4. The method of claim 1, wherein said flowability improving agent is hexamethyldisilazane treated silicon dioxide.

5. The method of claim 1, wherein the positively charging inorganic fine powder has a cleaning ratio of from about 0.6 to about 4.0.

6. The method of claim 1, wherein the positively chargeable inorganic fine powder particles comprise pure cerium oxide or cerium oxide rich particles.

7. The method of claim 1, wherein the polymeric binder comprises a) styrene and b) an alkyl acrylate, methacrylate, or both, and the styrene content of the binder is at least about 60% by weight.

8. The method of claim 1, wherein the toner further comprises a release agent.

9. The method of claim 8, wherein said release agent is a wax comprising low molecular weight polypropylenes, natural waxes, low molecular weight synthetic polymer waxes, stearic acid, salts thereof, or combinations thereof.

10. The method of claim 9, wherein the release agent is a wax present in an amount of from about 1 wt % to about 2 wt % , based on the weight of the developer.

11. The method of claim 8, wherein the release agent is a copolymer of ethylene and propylene.

12. The method of claim 1, wherein said flowability improving agent is present in an amount of from about 0.2 to about 2.0 wt % based on the total weight of the mixture of toner and the flowability improving agent.

13. The method of claim 12, wherein said flowability improving agent comprises silicon dioxide.

14. The method of claim 1, wherein said flowability improving agent is present in an amount of from about 0.48 to about 1.0 wt % based on the total weight of the mixture of toner and the flowability improving agent.

15. The method of claim 1, wherein said flowability improving agent is present in an amount of from about 0.70 to about 1.0 wt % based on the total weight of the mixture of toner and the flowability improving agent.

16. The method of claim 1, wherein said flowability improving agent comprises silicon dioxide.

* * * * *